US011774898B2

(12) United States Patent
Lee et al.

(10) Patent No.: US 11,774,898 B2
(45) Date of Patent: Oct. 3, 2023

(54) SELECTIVE GLOSS TREATMENT OF PRINT MEDIA

(71) Applicant: HEWLETT-PACKARD DEVELOPMENT COMPANY, L.P., Spring, TX (US)

(72) Inventors: Sun Hyung Lee, Seongnam-si (KR); Seung Jun Lee, Seongnam-si (KR); Choong Kyu Park, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/765,526

(22) PCT Filed: Sep. 18, 2020

(86) PCT No.: PCT/US2020/051449

§ 371 (c)(1),
(2) Date: Mar. 31, 2022

(87) PCT Pub. No.: WO2021/071654

PCT Pub. Date: Apr. 15, 2021

(65) Prior Publication Data

US 2022/0342355 A1 Oct. 27, 2022

(30) Foreign Application Priority Data

Oct. 7, 2019 (KR) ..... 10-2019-0123883

(51) Int. Cl.
*G03G 15/00* (2006.01)
*G03G 15/20* (2006.01)

(52) U.S. Cl.
CPC ..... *G03G 15/6585* (2013.01); *G03G 15/205* (2013.01); *G03G 2215/00805* (2013.01)

(58) Field of Classification Search
CPC ..... G03G 15/2021; G03G 15/6573; G03G 15/6585; G03G 2215/00805;
(Continued)

(56) References Cited

U.S. PATENT DOCUMENTS 5,024,181 A 6/1991 Shoji et al.
5,887,234 A * 3/1999 Aslam ..... G03G 15/2017 399/322

(Continued)

FOREIGN PATENT DOCUMENTS

CN 101187793 A 5/2008
JP 2007-102194 A 4/2007

(Continued)

*Primary Examiner* — Robert B Beatty
(74) *Attorney, Agent, or Firm* — Foley & Lardner LLP

(57) ABSTRACT

An image forming apparatus including a print engine, a gloss treatment device, a medium conveying device, and a processor. The print engine is to form an image on a print medium. The gloss treatment device is to perform a gloss treatment on the print medium on which an image is formed. The medium conveying device to provide the print medium to the print engine and selectively provide the print medium on which an image is formed to the gloss treatment device. The processor is to control the print engine to form an image based on print data and control the medium conveying device to selectively provide the print medium to the gloss treatment device depending on whether a gloss treatment option is set in the print data.

15 Claims, 8 Drawing Sheets

(58) Field of Classification Search
CPC .. G03G 2215/00426; G03G 2215/0081; B41F 23/08; B41M 7/009
USPC ..... 399/341
See application file for complete search history.

(56) References Cited

U.S. PATENT DOCUMENTS

| | | | | |
|---|---|---|---|---|
| 2002/0098022 | A1* | 7/2002 | Kabashima | G03G 15/20 399/341 |
| 2003/0180074 | A1* | 9/2003 | Noya | G03G 15/2064 399/328 |
| 2010/0028064 | A1* | 2/2010 | Shiozawa | G03G 15/161 399/341 |
| 2011/0076073 | A1* | 3/2011 | Omata | G03G 15/6585 399/341 |
| 2011/0129248 | A1* | 6/2011 | Shiozawa | G03G 15/6585 399/82 |
| 2012/0051812 | A1* | 3/2012 | Yamano | G03G 15/2064 399/341 |
| 2012/0219336 | A1* | 8/2012 | Moteki | G03G 15/2021 399/341 |
| 2013/0149017 | A1* | 6/2013 | Amita | G03G 15/6585 399/341 |
| 2013/0206061 | A1 | 8/2013 | Shimao et al. | |
| 2014/0064809 | A1 | 3/2014 | Yamaguchi et al. | |
| 2015/0138266 | A1 | 5/2015 | Chen et al. | |
| 2018/0246459 | A1* | 8/2018 | Yamamoto | G03G 15/5029 |

FOREIGN PATENT DOCUMENTS

| | | | |
|---|---|---|---|
| JP | 2009-175446 | A | 8/2009 |
| JP | 2009-288733 | A | 12/2009 |
| JP | 2012-13761 | A | 1/2012 |
| JP | 2012-42876 | A | 3/2012 |
| JP | 2013-41149 | A | 2/2013 |
| JP | 2013-195632 | A | 9/2013 |

* cited by examiner

SELECTIVE GLOSS TREATMENT OF PRINT MEDIA

BACKGROUND

An image forming apparatus refers to an apparatus that prints printing data generated in a printing control terminal device such as a computer on a recording medium. Examples of such an image forming apparatus may include a copier, a printer, a facsimile; and a multi-function printer (MFP) in which functions of the copier, the printer, and the facsimile are complexly implemented through one apparatus.

DETAILED DESCRIPTION

Hereinafter, various examples will be described in detail with reference to the drawings. Examples described below may be modified into several different forms. To clearly describe features of examples, a detailed description for contents well-known to those skilled in the art to which the following examples belong will be omitted.

Meanwhile, when any component is referred to as being "connected to" another component in the specification, it may refer to any component and another component being "directly connected to" each other or are "connected to" each other with a different component or components interposed therebetween. In addition, when any component is referred to as "including" another component, it may refer to the inclusion of other components rather than the exclusion of other components, unless explicitly described to the contrary.

In the specification, an "image forming job" may refer to various jobs (for example, printing, scanning, or faxing) related to an image, such as forming of the image, or creating/storing/transmitting of an image file, and a "job" may refer to the image forming job, but may also include a series of processes for performing the image forming job.

In addition, the "image forming apparatus" may refer to an apparatus that prints printing data generated in a terminal device such as a computer on a recording medium. Examples of such an image forming apparatus may include a copier, a printer, a facsimile, and a multi-function printer (MFP) in which functions of the copier, the printer, and the facsimile are complexly implemented through one apparatus.

Further, the "printing data" may refer to data converted into a format printable in a printer.

Further, a "user" may refer to a person performing an operation related to the image forming job using the image forming apparatus or using a device connected to the image forming apparatus in a wired or wireless manner.

Figure 1:
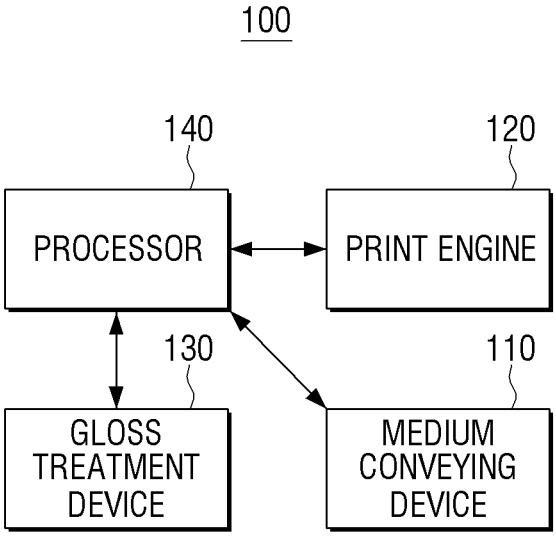
FIG. 1 is a block diagram illustrating a schematic configuration of an image forming apparatus according to an example.

FIG. 1 is a block diagram illustrating simple components of an image forming apparatus according to an example.

Referring to FIG. 1, an image forming apparatus 100 may include a medium conveying device 110, a print engine 120, a gloss treatment device 130, and a processor 140.

The medium conveying device 110 may convey a print medium (or paper). For example, the medium conveying device 110 may include a single-sided printing conveying path in which a loaded print medium is picked up and provided to the print engine 120, a double-sided printing conveying path in which a printing side of a print medium having one side printed by the print engine 120 is changed and the print medium having one side printed by the print engine 120 is provided to the print engine 120 again, and a gloss treatment conveying path which branches off from the double-sided printing conveying path and in which a print medium having one side printed is provided to the gloss treatment device 130.

For example, in a single-sided printing process, the medium conveying device 110 may pick up a print medium loaded in a loading tray, provide the print medium to the print engine 120, and discharge a print medium on which an image is formed by the print engine 120 to the outside, by using the single-sided printing conveying path.

The medium conveying device 110 may provide the print medium having one side printed to the single-sided printing conveying path again by using the double-sided printing conveying path. In case that the print medium is transferred to the single-sided printing conveying path again through the double-sided printing conveying path, the corresponding print medium may be provided to the print engine 120 with a printing side different from that at the time of being transferred to the single-sided printing conveying path for the first time.

In a gloss treatment process, the medium conveying device 110 may provide a print medium having one side printed to the gloss treatment conveying path by using the double-sided printing conveying path. A specific configuration and operation of the medium conveying device 110 will be described below with reference to FIGS. 5 to 7.

The print engine 120 may form an image on the print medium. For example, the print engine 120 may form an image on the print medium in an electrophotographic manner. For example, the print engine 120 may include cyan toner, magenta toner, yellow toner, black toner, and clear toner. The print engine 120 may perform color printing by using the cyan toner, the magenta toner, the yellow toner, and the black toner in a normal printing process, and may perform color printing by using the cyan toner, the magenta toner, the yellow toner, the black toner, and the clear toner in case that a gloss treatment option is set.

Here, the clear toner is toner without pigment which provides color in normal toner. For example, in the color printing, a white color may be implemented by not developing toner.

However, there may be a difference in degree of gloss between a region in which the toner is fused and a region in which the toner is not developed. Therefore, according to the disclosure, to allow the degrees of gloss in the two regions to be the same as or similar to each other, the clear toner is developed even in the region (that is, a white color region)

in which the toner is not developed according to the related art to make the white color region have the high degree of gloss.

Meanwhile, although the case that the clear toner is developed in a region in which other color toner is not developed has been described above, the clear toner may be developed while overlapping with another color toner, and the color toner may also be developed in a region that is determined as an image region in an entire region of a print medium, at the time of actual implementation. That is, the clear toner may not be developed in an outer edge region of the print medium.

Further, the print engine 120 includes a fuser and may fuse the toner developed on the print medium by using the fuser. The print medium on which the toner is fused may be discharged to the outside or provided to the gloss treatment device 130 by the medium conveying device 110 in a selective manner.

The gloss treatment device 130 may perform a gloss treatment on a print medium on which an image is formed. For example, the gloss treatment device 130 may perform a heating process, a cooling process, and a separating process on a print medium on which an image is formed to give gloss to the print medium. A specific configuration and operation of the gloss treatment device 130 will be described below with reference to FIG. 3.

The processor 140 controls the respective components in the image forming apparatus 100. The processor 140 may be implemented by a single device such as a central processing unit (CPU), or may be implemented by a plurality of devices such as a clock generation circuit, a CPU, and a graphic processor.

Once printing data are received, the processor 140 may perform processing such as parsing on the received printing data to generate binary data, and control the print engine 120 to print the generated binary data.

Here, the processor 140 may determine whether or not the gloss treatment option is set. In case that it is determined that the gloss treatment option is not set, the processor 140 may generate binary data for each of four colors including C, M, Y, and K, and control the medium conveying device 110 to convey the print medium along the usual conveying path. Here, in case that the gloss treatment option is not set in the print data, the processor 140 may control the medium conveying device 110 to pick up the loaded print medium at an interval of a first time.

In case that the gloss treatment option is set, the processor 140 may generate binary data for each of five colors including C, M, Y, K, and clear color. That is, in case that the gloss treatment option is set, the processor 140 may control the print engine 120 to develop the clear toner.

Further, in case that the gloss treatment option is set in the print data, the processor 140 may control the medium conveying device 110 to pick up the loaded print medium at an interval of a second time longer than the first time.

The processor 140 may control the medium conveying device 110 to convey the print medium to the gloss treatment device. Here, the processor 140 may control the medium conveying device 110 to convey the print medium in the gloss treatment conveying path at a speed lower than that in the single-sided printing conveying path.

Further, the processor 140 may make a conveying speed, at which the print medium is conveyed in the single-sided printing conveying path, constant regardless of whether or not the gloss treatment option is set. However, in case that the gloss treatment option is set, the processor 140 may control the medium conveying device 110 to convey the print medium in the double-sided printing conveying path and the gloss treatment conveying path at a conveying speed lower than that in the single-sided printing conveying path. A relationship between the gloss treatment and the conveying speed will be described below with reference to FIG. 4.

Meanwhile, the schematic configuration of the image forming apparatus is illustrated and described hereinabove, and various components may be further included in the image forming apparatus at the time of actual implementation. Those will be described below with reference to FIG. 2.

Figure 2:
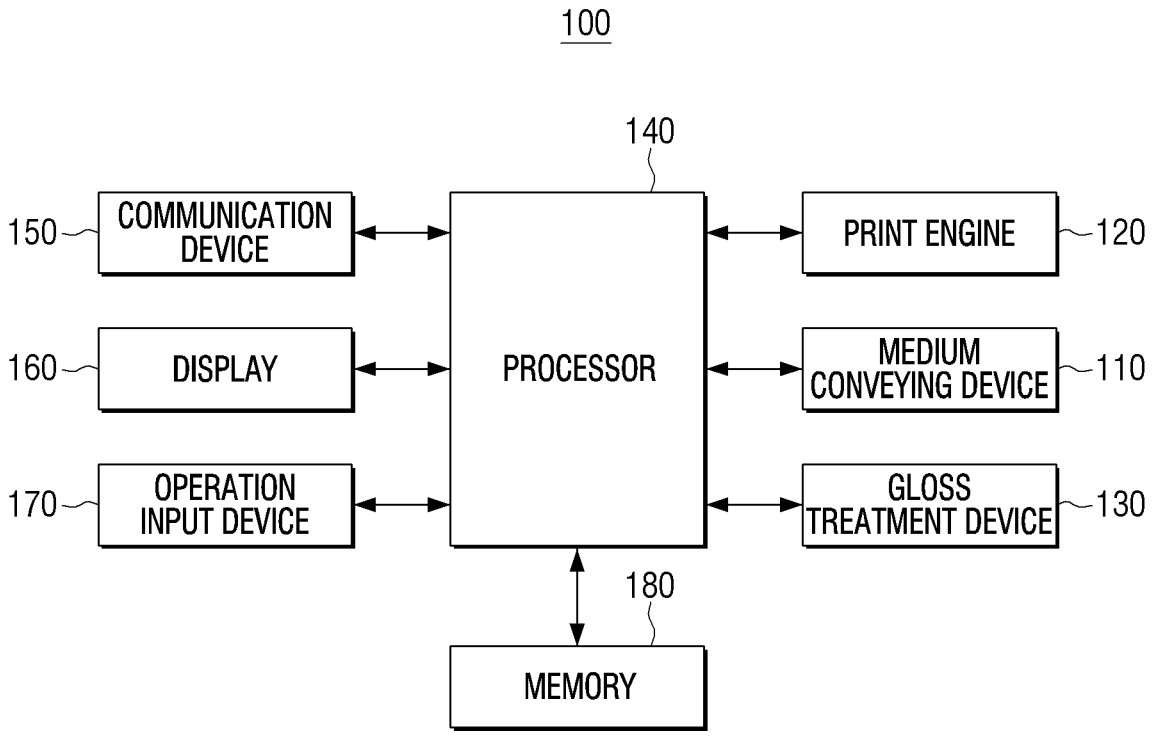
FIG. 2 is a block diagram illustrating a specific configuration of the image forming apparatus according to an example.

FIG. 2 is a block diagram illustrating a specific configuration of the image forming apparatus according to an example.

Referring to FIG. 2, an image forming apparatus 100 may include the medium conveying device 110, the print engine 120, the gloss treatment device 130, the processor 140, a communication device 150, a display 160, an operation input device 170, and a memory 180.

The medium conveying device 110, the print engine 120, and the gloss treatment device 130 have been described above with reference to FIG. 1, and thus an overlapping description will be omitted. Further, the processor 140 has also been described above with reference to FIG. 1, and thus an overlapping description with reference to FIG. 1 will be omitted, and a description about additional components in FIG. 2 will be provided below.

The communication device 150 is formed to connect the image forming apparatus 100 to an external apparatus (not illustrated), and may be connected to the external apparatus through a local area network (LAN) and the Internet network or be connected to the external apparatus through a USB port or a wireless communication (for example, wireless fidelity (Wi-Fi), 802.11a/b/g/n, near field communication (NFC), or Bluetooth) port. Such a communication device 150 may also be referred to as a transceiver.

The communication device 150 may receive a control command through the external apparatus and receive print data. Such a print data may include information on a printing option that is set in the corresponding print data, and one of the printing options may be the gloss treatment option. Here, the gloss treatment option is an option to perform the gloss treatment on the print medium by using the above-described gloss treatment device 130.

The display 160 displays a user interface window for the user to select a function supported by the image forming apparatus 100. For example, the display 160 may display the user interface window for the user to select various functions provided by the image forming apparatus 100. Such a display 160 may be a monitor such as a liquid crystal display (LCD) monitor, a cathode ray tube (CRT) monitor, or an organic light emitting diode (OLED) monitor, and may also be implemented by a touch screen which can simultaneously function as the operation input device 170.

The display 160 may display a user interface window for the user to select a print job and set a print option to be applied to the selected print job.

The operation input device 170 may receive selection of a function and a control command for the corresponding function from the user. Here, the function may include a print function, a copy function, a scan function, a facsimile transmission function, and the like.

Further, the operation input device 170 may receive, from the user, selection of whether or not to apply the gloss treatment function. Meanwhile, such a gloss treatment function may be selected in case that the color printing (or photo printing) is selected, at the time of actual implementation.

The memory 180 may store a program for driving the image forming apparatus 100. Further, the memory 180 may store print data received from a printing control terminal apparatus (not illustrated).

Once the print data are received through the communication device 150, the processor 140 may perform a parsing operation on the received print data. Further, the processor 140 may check whether or not the gloss treatment option is set in the print data through the parsing operation.

In case that the gloss treatment option is not set, the processor 140 may control the medium conveying device 110 and the print engine 120 to perform a print job in a normal manner.

On the contrary, in case that the gloss treatment option is set, the processor 140 may control the medium conveying device 110 to perform a print job in a normal manner first. Here, the processor 140 may control the medium conveying device 110 to pick up the medium at a longer time interval, in comparison to that in a normal printing process.

Once printing of one side of the print medium performed by the print engine 120 is completed, the processor 140 may control the medium conveying device 110 to provide the corresponding print medium to the gloss treatment device 130. The processor 140 may control the gloss treatment device 130 to perform the gloss treatment on the print medium provided to the gloss treatment device 130.

As described above, the image forming apparatus 100 according to the disclosure selectively provides, to the gloss treatment device, a print medium that needs to be subjected to the gloss treatment, and thus a life span of a belt of the gloss treatment device 130 may be increased. Further, in the image forming apparatus 100, since the print medium does not pass through the gloss treatment device when the gloss treatment is not selected, the print medium need not be conveyed at a low speed, thereby making it possible to more rapidly perform the print job.

Figure 3:
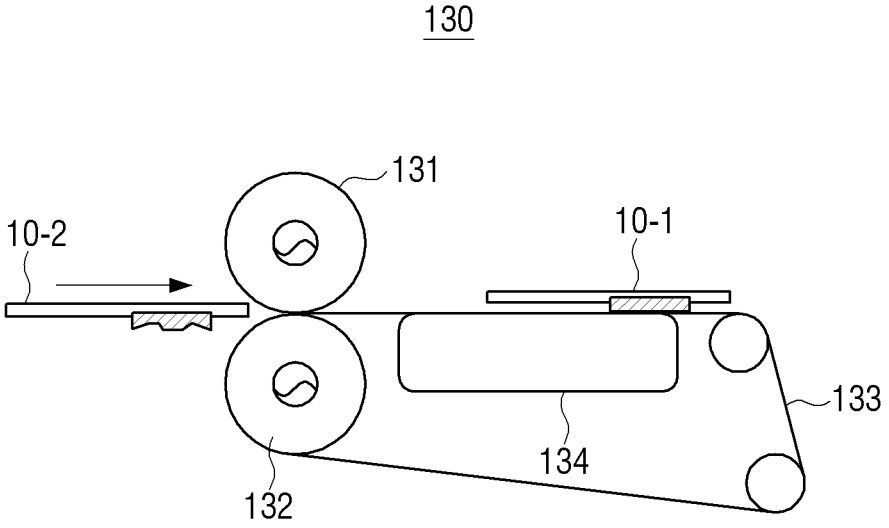
FIG. 3 is a view illustrating an example of a specific configuration of a gloss treatment device of FIG. 1.

FIG. 3 is a view illustrating a specific configuration of the gloss treatment device of FIG. 1.

Referring to FIG. 3, the gloss treatment device 130 may include a heating roller 131, a pressure roller 132, a belt 133, and a cooling device 134.

The heating roller 131 may heat the provided print medium. For example, in the heating roller 131, a heater such as a halogen lamp is positioned in a cylindrical base, and an elastic layer and a releasing layer may be disposed on a hollow metal core formed of aluminum (Al) or stainless steel (SUS). Meanwhile, at the time of actual implementation, the releasing layer may be implemented in the same way without the elastic layer.

The pressure roller 132 may be disposed to face the heating roller 131 and provide a high pressure to the print medium. For example, the heating roller 131 is attached to a surface of the pressure roller 132 and a predetermined nip may be maintained. Further, in the pressure roller 132, a heat-resistant elastic layer, and a releasing layer using a heat-resistant resin film or a heat-resistant rubber film may be disposed on a cylindrical core. Meanwhile, the pressure roller 132 may also include a heater at the time of actual implementation.

The belt 133 rotates while being in contact with an outer circumferential surface of the pressure roller. In such a belt 133, a base layer formed of at least one of a heat-resistant resin or metal, and a releasing layer formed on a surface of the base layer and formed of a fluorine-based resin may be disposed. Further, an elastic layer may be disposed on the releasing layer.

Here, the base layer may be formed of a heat-resistant resin such as polyimide (PI), polyamide (PA), or polyamideimide (PAI), or metal such as stainless steel (SUS) or nickel (Ni), and may have a thickness of 30 to 200 μm (for example, 50 to 100 μm).

The release layer may be formed of a fluorine-based resin such as perfluoroalkoxy (PFA), polytetrafluoroethylene (PTFE), or fluorinated ethylene propylene (FEP). Further, the releasing layer may have a thickness of about 10 to 30 mm.

The elastic layer may be formed of an elastic material such as various rubber materials such as fluorine rubber, silicone rubber, natural rubber, isoprene rubber, butadiene rubber, nitrile rubber, chloroprene rubber, butyl rubber, acrylic rubber, hydrin rubber, and urethane rubber, or various thermoplastic elastomers such as a styrene-based elastomer, a polyolefin-based elastomer, a polyvinyl-chloride-based elastomer, a polyurethane-based elastomer, a polyester-based elastomer, a polyamide-based elastomer, a polybutadiene-based elastomer, a trans-polyisoprene-based elastomer, and a chlorinated-polyethylene-based elastomer, or may be formed of a mixture of one or two or more thereof. Such an elastic layer may have a thickness of 100 to 300 μm and, the elastic layer may be omitted at the time of actual implementation.

The cooling device 134 may be disposed on one side of the belt 133 and cool the print medium passing through the nip formed by the heating roller 131 and the pressure roller 132.

Further, the print medium cooled by the cooling device 134 may be separated by a separation device (not illustrated) and discharged to the outside.

A device which gives gloss to a general medium through the heating process, the cooling process, and the separating process as described above is referred to as a gloss treatment (or photo finishing (PF)) device. In such a gloss treatment device, an image with a high gloss may be formed in case that a re-heated image is cooled by the cooling device and separated from the belt with which the re-heated image is in contact.

Here, a gloss of a surface of a fuser belt greatly affects a degree of gloss of a printed high-gloss image. Further, since the fuser belt rotates while being in continuous contact with a medium or a medium with an image on the surface of the fuser belt under a high-pressure condition in the nip, once abrasion of a surface of the fuser belt occurs, a life span of the gloss treatment device 130 may be affected thereby.

Hereinafter, a relationship between a conveying speed in the gloss treatment device 130 and a degree of gloss will be described with reference to FIG. 4.

Figure 4:
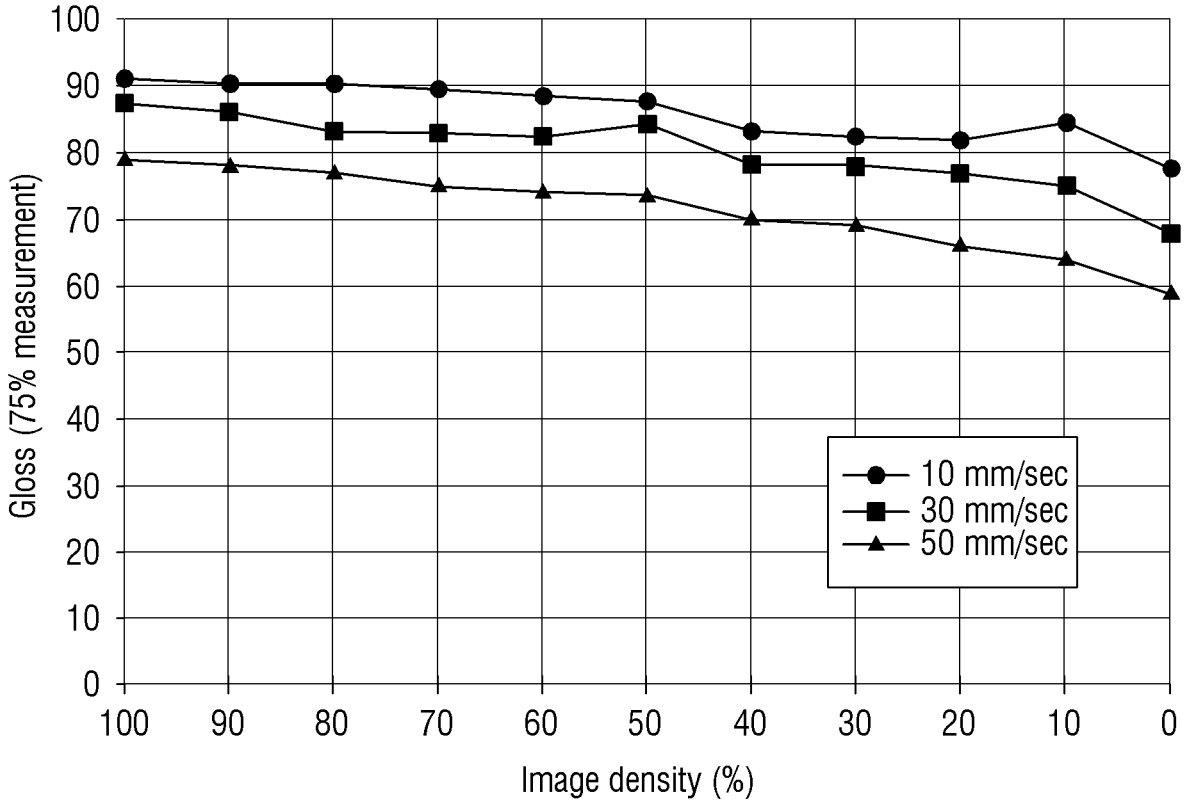
FIG. 4 is a graph for describing variation in degree of gloss depending on a conveying speed and an image density.

FIG. 4 is a graph for describing variation in degree of gloss depending on a conveying speed and an image density.

Referring to FIG. 4, it may be appreciated that the higher the image density becomes, the higher the degree of gloss after the gloss treatment becomes.

Further, it may be appreciated that the higher the conveying speed in the gloss treatment device becomes, the lower the degree of gloss of the image after the gloss treatment becomes, as compared with the case that the conveying speed is low. For example, it may be appreciated that the degree of gloss at a low image density is equal to or lower than 60 in case that the gloss treatment is performed at a conveying speed of 50 mm/s.

As such, it may be understood that the degree of gloss of the image after the gloss treatment is greatly affected by the conveying speed. Therefore, the conveying speed needs to be decreased in the gloss treatment device to increase the degree of gloss.

In this regard, according to the disclosure, the print medium is fed to the gloss treatment device when the gloss treatment is selected, and thus it is possible to improve a life span of the belt in the gloss treatment device and maintain a high printing speed in the normal printing process.

A medium conveying manner for such an operation will be described below with reference to FIGS. 5 to 7.

Figure 5:
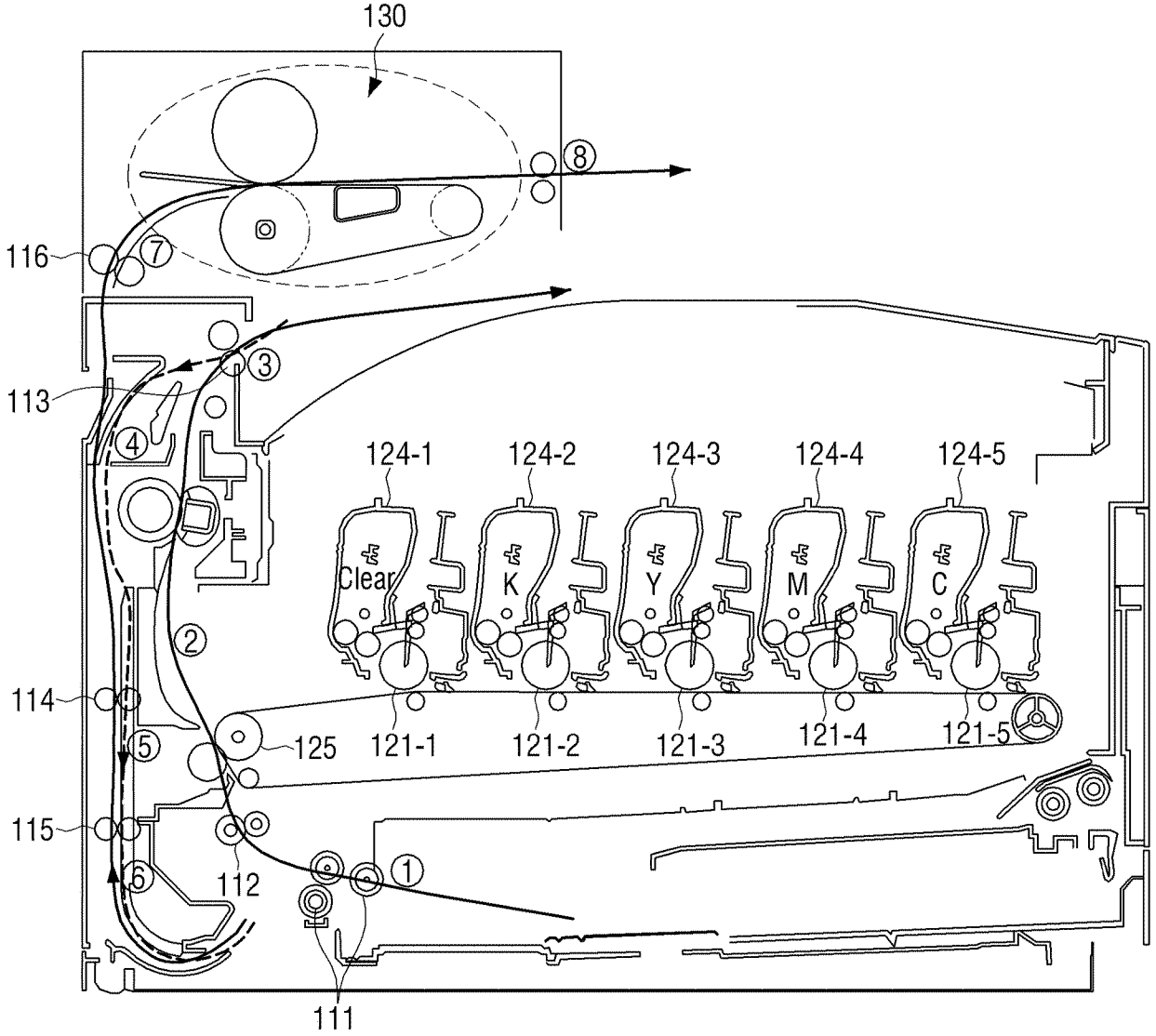
FIG. 5 is a view for describing a medium conveying path according to a first example.

FIG. 5 is a view for describing a medium conveying path according to a first example. For example, the medium conveying path according to the first example is applied to an example in which the gloss treatment device 130 is installed in an upper portion of the image forming apparatus 100.

Referring to FIG. 5, the medium conveying device may include a plurality of conveying rollers 111 to 116.

Here, first to third conveying rollers 111 to 113 may form the single-sided printing conveying path. For example, the first conveying roller 111 may pick up a medium loaded in a loading tray and feed the picked-up medium to the single-sided printing conveying path.

The second conveying roller 112 may provide the picked-up print medium to the print engine 120. Such a second conveying roller 112 may be referred to as a registration roller.

The third conveying roller 113 may discharge the print medium fused by the fuser to the outside or feed the print medium fused by the fuser to the double-sided printing conveying path, in a selective manner. For example, the third conveying roller 113 may discharge the print medium to the outside in a single-sided printing process, and selectively convey the print medium that needs to be subjected to double-sided printing or gloss treatment toward the fourth conveying roller 114.

For example, the third conveying roller 113 may rotate in a first direction to discharge the print medium fused by the fuser to the outside, and once the entire print medium passes through the fuser, the third conveying roller 113 may rotate (that is, reversely rotate) in a second direction opposite to the first direction to feed the print medium having one side on which an image is formed to the double-sided printing conveying path.

The third to fifth conveying rollers 113 to 115 may form the double-sided printing conveying path.

The fourth conveying roller 114 and the fifth conveying roller 115 may provide the print medium provided from the third conveying roller 113 to the single-sided printing conveying path again, or may reversely rotate to provide the print medium provided from the third conveying roller 113 to the gloss treatment device 130.

For example, the fourth conveying roller 114 and the fifth conveying roller 115 may convey the print medium provided from the third conveying roller 113 in the same direction to provide the corresponding print medium to the single-sided printing conveying path again.

On the contrary, in case of performing the gloss treatment, the fourth conveying roller 114 and the fifth conveying roller 115 may rotate in the first direction to convey the print medium provided from the third conveying roller 113 to the inside of the double-sided printing conveying path, and once the entire corresponding print medium enters the double-sided printing conveying path, the fourth conveying roller 114 and the fifth conveying roller 115 may rotate (that is, reversely rotate) in the second direction opposite to the first direction to provide the print medium to the gloss treatment conveying path.

The sixth conveying roller 116 is a roller that provides, to the gloss treatment device 130, a print medium provided through the double-sided printing conveying path. The fourth to sixth conveying rollers 114 to 115 may form the gloss treatment conveying path. Here, a medium conveying speed in the gloss treatment conveying path may be lower than a medium conveying speed in the single-sided printing conveying path.

Here, the above-described operation will be briefly described. The print medium may be conveyed through paths ①, ②, and ③ in this order and discharged in the single-sided printing process according to the first example. The print medium may be conveyed through paths ①, ②, ③, ④, ⑤, ⑥, ②, and ③ in this order and discharged in the double-sided printing process. Further, the print medium may be conveyed through paths ①, ②, ③, ④, ⑤, ⑥, ⑤, ④, ⑦, and ⑧ in this order and finally discharged in the gloss treatment process.

Meanwhile, referring to the example illustrated in FIG. 5, the print engine 120 may include a plurality of photosensitive drums 121-1 to 121-5, and a plurality of developers 124-1 to 124-5. Here, the first photosensitive drum 121-1 and the first developer 124-1 are devices which develop the clear toner.

An image developed on an intermediate transfer belt by the plurality of photosensitive drums and the plurality of developers may be transferred onto a print medium through a transfer 125.

Figure 6:
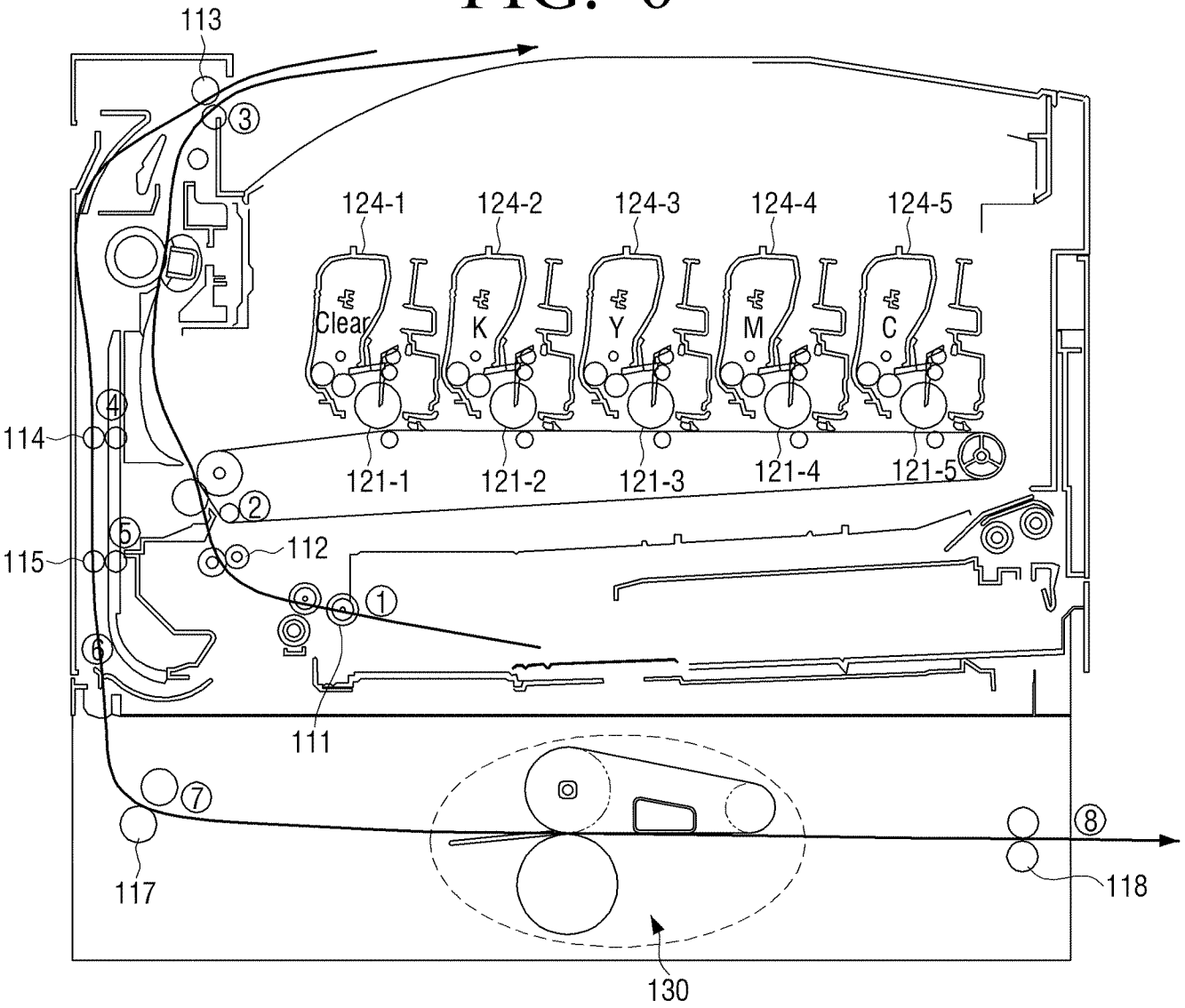
FIG. 6 is a view for describing a medium conveying path according to a second example.

FIG. 6 is a view for describing a medium conveying path according to a second example. For example, the medium conveying path according to the second example is applied to an example in which the gloss treatment device is installed in a lower portion of the image forming apparatus.

Referring to FIG. 6, a medium conveying device may include a plurality of conveying rollers 111, 112, 113, 114, 115, 117, and 118.

A single-sided printing conveying path and a double-sided printing conveying path are operated in the same manner as that of the single-sided printing conveying path and the double-sided printing conveying path of FIG. 5, and thus an overlapping description will be omitted.

The seventh conveying roller 117 is a roller that provides, to the gloss treatment device 130, a print medium provided through the double-sided printing conveying path. Meanwhile, in case of performing the gloss treatment, a speed at which the print medium is conveyed in the double-sided printing conveying path may be sufficiently decreased and the print medium may be provided to the seventh conveying roller 117.

The eighth conveying roller 118 is a roller that discharges a medium processed in the gloss treatment device to the outside.

The print medium may be conveyed through paths ①, ②, and ③ in this order and discharged in a single-sided printing process according to the second example, the print medium may be conveyed through paths ①, ②, ③, ④, ⑤, ⑥, ②, and ③ in this order and discharged in a double-sided printing process, and the print medium may be conveyed through paths ①, ②, ③, ④, ⑤, ⑥, ⑦, and ⑧ in this order, subjected to the gloss treatment, and then discharged in a gloss treatment process.

Figure 7:
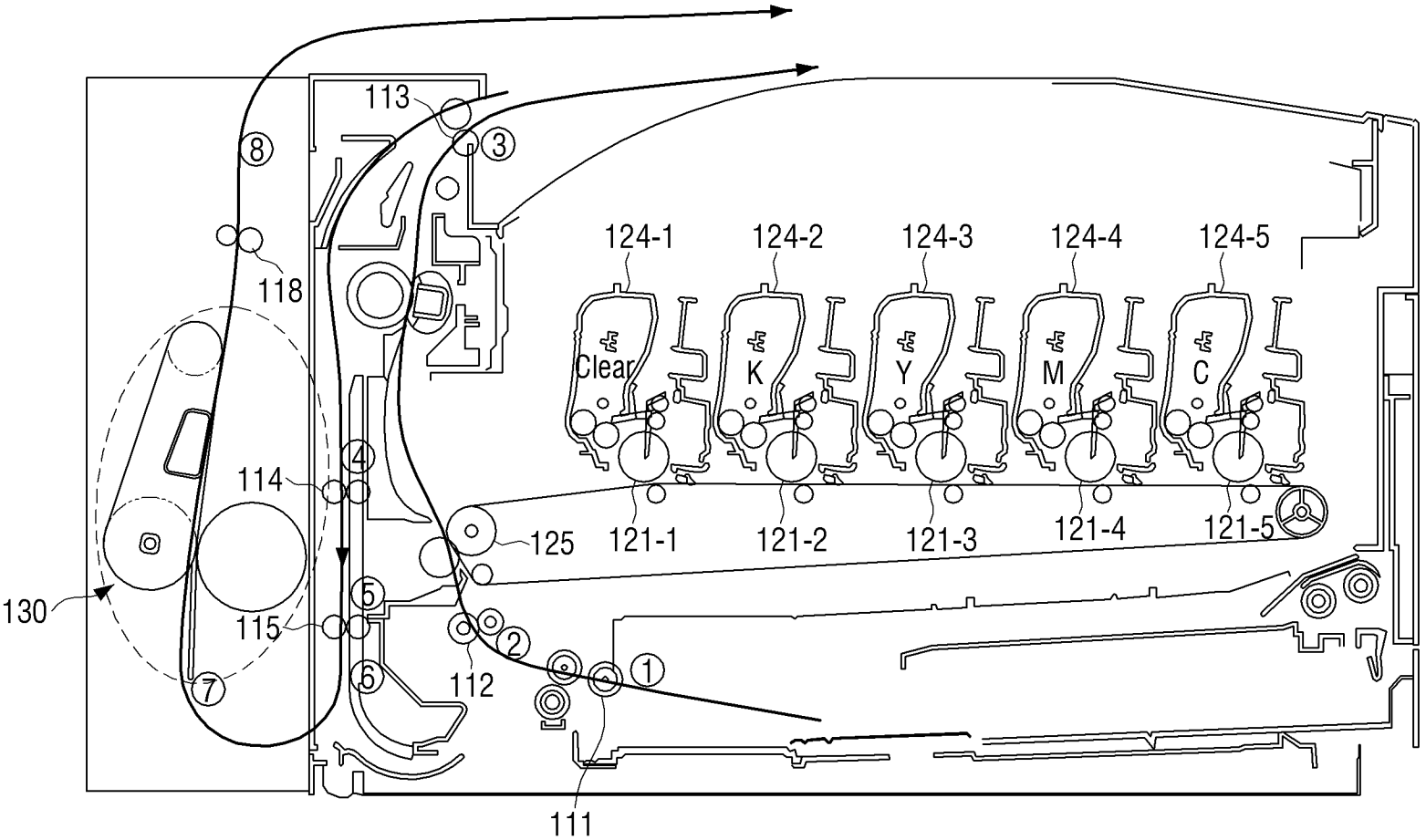
FIG. 7 is a view for describing a medium conveying path according to a third example.

FIG. 7 is a view for describing a medium conveying path according to a third example. For example, the medium conveying path according to the third example is applied to an example in which the gloss treatment device is installed in a side portion of the image forming apparatus.

Referring to FIG. 7, a medium conveying device may include a plurality of conveying rollers 111, 112, 113, 114, 115, and 118.

A single-sided printing conveying path and a double-sided printing conveying path are operated in the same manner as that of FIG. 5, and thus an overlapping description will be omitted.

The eighth conveying roller 118 is a roller that discharges a medium processed in the gloss treatment device to the outside.

According to the third example, the print medium may be conveyed through paths ①, ②, and ③ in this order and discharged in a single-sided printing process, the print medium may be conveyed through paths ①, ②, ③, ④, ⑤, ⑥, ②, and ③ in this order and discharged in a double-sided printing process, and the print medium may be conveyed through paths ①, ②, ③, ④, ⑤, ⑦, and ⑧ in this order, subjected to the gloss treatment, and then discharged in a gloss treatment process.

As described above, the medium conveying devices according to the first to third examples provide the print medium to the gloss treatment device when the gloss treatment is selected, and thus it is possible to prevent abrasion of the gloss treatment device and maintain the life span of the gloss treatment device.

Further, since the print medium may be selectively provided to the gloss treatment device, a print job may be performed at a high speed in case that the gloss treatment is not selected, and a degree of gloss may be increased by performing the print job at a low speed in case that the gloss treatment is selected.

Meanwhile, although the case that the double-sided printing conveying path is provided and the gloss treatment conveying path branches off from the double-sided printing conveying path has been described and illustrated in FIGS. 5 to 7, the image forming apparatus 100 that does not provide the double-sided printing function may not include the double-sided printing conveying path at the time of actual implementation and in this case, the gloss treatment conveying path may branch off from the single-sided printing conveying path.

For example, in case of FIG. 5, in the gloss treatment process, the print medium may move through the paths ①, ②, and ③ to have one side printed, and once fusing of the entire print medium is completed, the third conveying roller 113 may reversely rotate to provide the print medium directly to the gloss treatment device 130.

Figure 8:
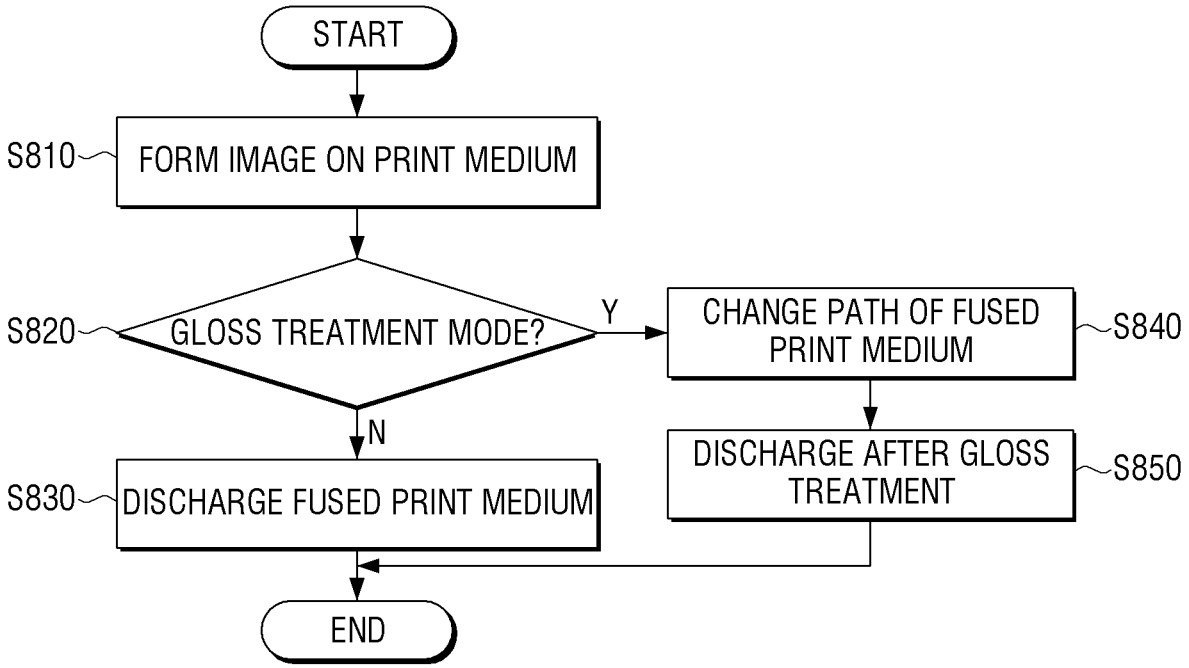
FIG. 8 is a flow chart for describing an image forming method according to an example.

FIG. 8 is a flow chart for describing an image forming method according to an example.

Referring to FIG. 8, an image corresponding to print data may be formed on a conveyed print medium (S810). For example, a print medium may be picked up and conveyed along the single-sided printing conveying path. Then, the image may be formed on the conveyed print medium. Here, in case that a gloss treatment mode is not set in the print data, the image may be formed by using four toners as usual, and in case that the gloss treatment mode is set, the image may be formed by using the cyan toner, the magenta toner, the yellow toner, the black toner, and the clear toner.

Whether or not the gloss treatment option is set in the print data may be checked (S820), and the gloss treatment may be selectively performed on the print medium on which the image is formed.

For example, in the case that the gloss treatment option is not set (S820—N), the print medium on which the image is formed may be discharged as it is (S830). On the contrary, in the case that the gloss treatment option is set (S820—Y), the print medium having one side printed may be additionally conveyed through the double-sided printing conveying path and the gloss treatment conveying path and provided to the gloss treatment device (S840). Then, the corresponding print medium may be subjected to the gloss treatment (S850).

As described above, in the image forming method according to the example, a print medium that needs to be subjected to the gloss treatment is selectively provided to the gloss treatment device, and thus a lifetime of the belt of the gloss treatment device may be increased. Further, in the image forming method, since the print medium does not pass through the gloss treatment device when the gloss treatment is not selected, it is possible to perform printing at the same speed (that is, high speed) in the normal printing process.

Meanwhile, the image forming method described above may be implemented by a program and be provided to the image forming apparatus. Particularly, a program including the image forming method may be stored and provided in a non-transitory computer readable medium.

Although examples have been illustrated and described hereinabove, the disclosure is not limited thereto, but may be variously modified by those skilled in the art to which the disclosure pertains without departing from the spirit and scope of the disclosure claimed in the claims. These modifications are to fall within the scope of the disclosure.

What is claimed is:

1. An image forming apparatus comprising:

a print engine to form an image on a print medium;

a gloss treatment device to perform a gloss treatment on the print medium on which the image is formed;

a medium conveying device to provide the print medium to the print engine and to selectively provide the print medium on which the image is formed to the gloss treatment device; and a processor to control the print engine to form the image based on print data and control the medium conveying device to selectively provide the print medium to the gloss treatment device depending on whether a gloss treatment option is set in the print data, the processor to control the medium conveying device to convey the print medium along a single-sided printing conveying path, a double-sided printing conveying path and a gloss treatment conveying path, when the gloss treatment option is set in the print data.

2. The image forming apparatus as claimed in claim 1, wherein the medium conveying device is to convey the print medium by using the single-sided printing conveying path in which the print medium is picked up and provided to the print engine, the double-sided printing conveying path in which a printing side of the print medium is changed and the print medium is provided to the print engine again, and the gloss treatment conveying path that branches off from the double-sided printing conveying path and provides the print medium to the gloss treatment device.

3. The image forming apparatus as claimed in claim 2, wherein the processor is to control the medium conveying device to convey the print medium along the single-sided printing conveying path when the gloss treatment option is not set in the print data.

4. The image forming apparatus as claimed in claim 2, wherein the processor is to control the medium conveying device to convey the print medium in the gloss treatment conveying path at a speed lower than that in the single-sided printing conveying path.

5. The image forming apparatus as claimed in claim 2, wherein the processor is to control the medium conveying device to pick up the print medium at an interval of a first time when the gloss treatment option is not set in the print data, and the processor is to control the medium conveying device to pick up the print medium at an interval of a second time longer than the first time when the gloss treatment option is set in the print data.

6. The image forming apparatus as claimed in claim 5, wherein a conveying speed, at which the print medium is conveyed in the single-sided printing conveying path, is constant regardless of whether the gloss treatment option is set.

7. The image forming apparatus as claimed in claim 1, wherein the print engine forms the image by using cyan toner, magenta toner, yellow toner, black toner, and clear toner.

8. The image forming apparatus as claimed in claim 1, wherein the gloss treatment device includes:

a heating roller;

a pressure roller disposed to face the heating roller;

a belt to rotate while being in contact with an outer circumferential surface of the pressure roller; and a cooling device disposed on one side of the belt and to cool a print medium passing through a nip formed by the heating roller and the pressure roller.

9. The image forming apparatus as claimed in claim 8, wherein the belt includes:

a base layer formed of at least one of a heat-resistant resin or metal; and a releasing layer formed on a surface of the base layer and formed of a fluorine-based resin.

10. An image forming method comprising:

conveying a print medium;

forming an image corresponding to print data on the conveyed print medium;

determining whether a gloss treatment option is set in the print data; and selectively performing, based on the determining, a gloss treatment on the print medium on which the image is formed, wherein in the conveying, the print medium on which the image is formed is conveyed along a single-sided printing conveying path, a double-sided printing conveying path and a gloss treatment conveying path to a gloss treatment device, when the gloss treatment option is set in the print data, and the print medium on which the image is formed is discharged when the gloss treatment option is not set in the print data.

11. The image forming method as claimed in claim 10, wherein in the conveying, the print medium is conveyed by using the single-sided printing conveying path in which the print medium is picked up and provided to a print engine, the double-sided printing conveying path in which a printing side of the print medium is changed and the print medium is provided to the print engine again, and the gloss treatment conveying path that branches off from the double-sided printing conveying path and provides the print medium to the gloss treatment device.

12. The image forming method as claimed in claim 11, wherein in the conveying, the print medium is conveyed along the single-sided printing conveying path when the gloss treatment option is not set in the print data.

13. The image forming method as claimed in claim 11, wherein in the conveying, the print medium is conveyed in the gloss treatment conveying path at a speed lower than that in the single-sided printing conveying path.

14. The image forming method as claimed in claim 11, wherein in the conveying, the print medium is picked up at an interval of a first time when the gloss treatment option is not set in the print data, and the print medium is picked up at an interval of a second time longer than the first time when the gloss treatment option is set in the print data.

15. The image forming method as claimed in claim 10, wherein in the forming of the image, the image is formed by using cyan toner, magenta toner, yellow toner, black toner, and clear toner.

* * * * *